US007095376B1

(12) United States Patent
Timothy et al.

(10) Patent No.: US 7,095,376 B1
(45) Date of Patent: Aug. 22, 2006

(54) SYSTEM AND METHOD FOR POINTING AND CONTROL OF AN ANTENNA

(75) Inventors: LaMar K. Timothy, Kaysville, UT (US); Jeffrey S. Sato, Sandy, UT (US); Alan M. Buchanan, Sandy, UT (US); Patricia F. Batzer, North Salt Lake, UT (US)

(73) Assignee: L3 Communications Corporation, Salt Lake City, UT (US)

( * ) Notice: Subject to any disclaimer, the term of this patent is extended or adjusted under 35 U.S.C. 154(b) by 0 days.

(21) Appl. No.: 11/001,413

(22) Filed: Nov. 30, 2004

(51) Int. Cl.
*H01Q 3/08* (2006.01)

(52) U.S. Cl. ..... 343/705; 343/765

(58) Field of Classification Search ..... 343/705, 343/708, 765, 766, 882; 342/359
See application file for complete search history.

(56) References Cited

U.S. PATENT DOCUMENTS 2,740,962 A * 4/1956 Hammond, Jr. ..... 342/75
5,025,262 A 6/1991 Abdelrazik et al.
5,419,521 A 5/1995 Matthews
5,769,020 A 6/1998 Shields
6,208,307 B1 * 3/2001 Frisco et al. ..... 343/757
6,433,736 B1 8/2002 Timothy et al.

* cited by examiner

*Primary Examiner*—Michael C. Wimer
(74) *Attorney, Agent, or Firm*—Thorpe North & Western LLP

(57) ABSTRACT

A method is disclosed for directing an antenna mounted in a restricted radome on an aircraft. The method can include the operation of determining whether the antenna is directed in a keyhole. A further operation can involve controlling the antenna using an elevation gimbal and an azimuth gimbal when it is determined the antenna is directed outside the keyhole. Another operation can include directing the antenna using an elevation, azimuth, and cross elevation gimbal when it is determined the antenna is pointing in the keyhole.

23 Claims, 6 Drawing Sheets

AIR-TO-SATELLITE ANTENNA POINTING AND CONTROL

SYSTEM AND METHOD FOR POINTING AND CONTROL OF AN ANTENNA

FIELD OF THE INVENTION

The present invention relates generally to the directional control of antennae.

BACKGROUND

Some aircraft have the capability to communicate with satellites in various earth orbits, such as geosynchronous (GEO), low earth orbit (LEO), and polar orbit. Transmission of high data rates between aircraft and the satellites at a low power level requires a highly directive antenna with a large aperture area. Such a directive antenna strives to maintain accurate positioning to point the antenna in the direction of the satellite. The satellite is in constant motion in orbit around the earth. As the aircraft moves, it is subject to changes in latitude, longitude, and altitude. The aircraft's attitude, measured in roll, pitch and yaw, can also change relative to the satellite. A gimbaled antenna pedestal can be used to compensate for the movement of the satellite and changes in velocity, position, and attitude of the aircraft and allow the antenna mounted on the aircraft to maintain its focus on a satellite.

Most aircraft are composed of metal skins, such as aluminum. The metal skins can create a Faraday cage inside the aircraft which can substantially decrease any electromagnetic signals. To overcome this, the antenna and pedestal are usually mounted on the exterior of the aircraft.

The environment outside an aircraft, however, is not hospitable to most large area antennae. Antenna apertures typically require a specific large area shape to capture a desired electromagnetic signal. As a result, the required antenna shape is usually not very aerodynamic. The relatively high velocity air flow while an aircraft is in flight can also interfere with the movement of an antenna that is required to maintain the focus of the antenna on the satellite. Also, temperatures can often vary over one hundred degrees Celsius as an aircraft ascends and descends. The rapid change in temperature can cause problems with electrical systems associated with the antenna and pedestal.

Enclosures can be used to overcome the environmental problems associated with placing antennae on the outside of an aircraft. Antenna enclosures, called radomes, are constructed out of materials which are substantially transparent to electromagnetic radiation. Radomes should be as small as possible to minimize aerodynamic drag. A flattened radome can further minimize drag. However, accurate pointing and control are desired to be maintained as the aircraft rolls, pitches, and yaws in normal flight. It is desirable to control the movement of an antenna in a radome mounted on an aircraft to allow the antenna to be positioned to transmit and receive maximum power signals from a satellite to enable a communications link with minimal disruptions.

SUMMARY OF THE INVENTION

A method is disclosed for directing an antenna mounted in a restricted radome on an aircraft. The method can include the operation of determining whether the antenna is directed in a keyhole. A further operation can involve controlling the antenna using an elevation gimbal and an azimuth gimbal when it is determined the antenna is directed outside the keyhole. Another operation can include directing the antenna using an elevation, azimuth, and cross elevation gimbal when it is determined the antenna is pointing in the keyhole.

Additional features and advantages of the invention will be apparent from the detailed description which follows, taken in conjunction with the accompanying drawings, which together illustrate, by way of example, features of the invention.

DETAILED DESCRIPTION

Figure 1:
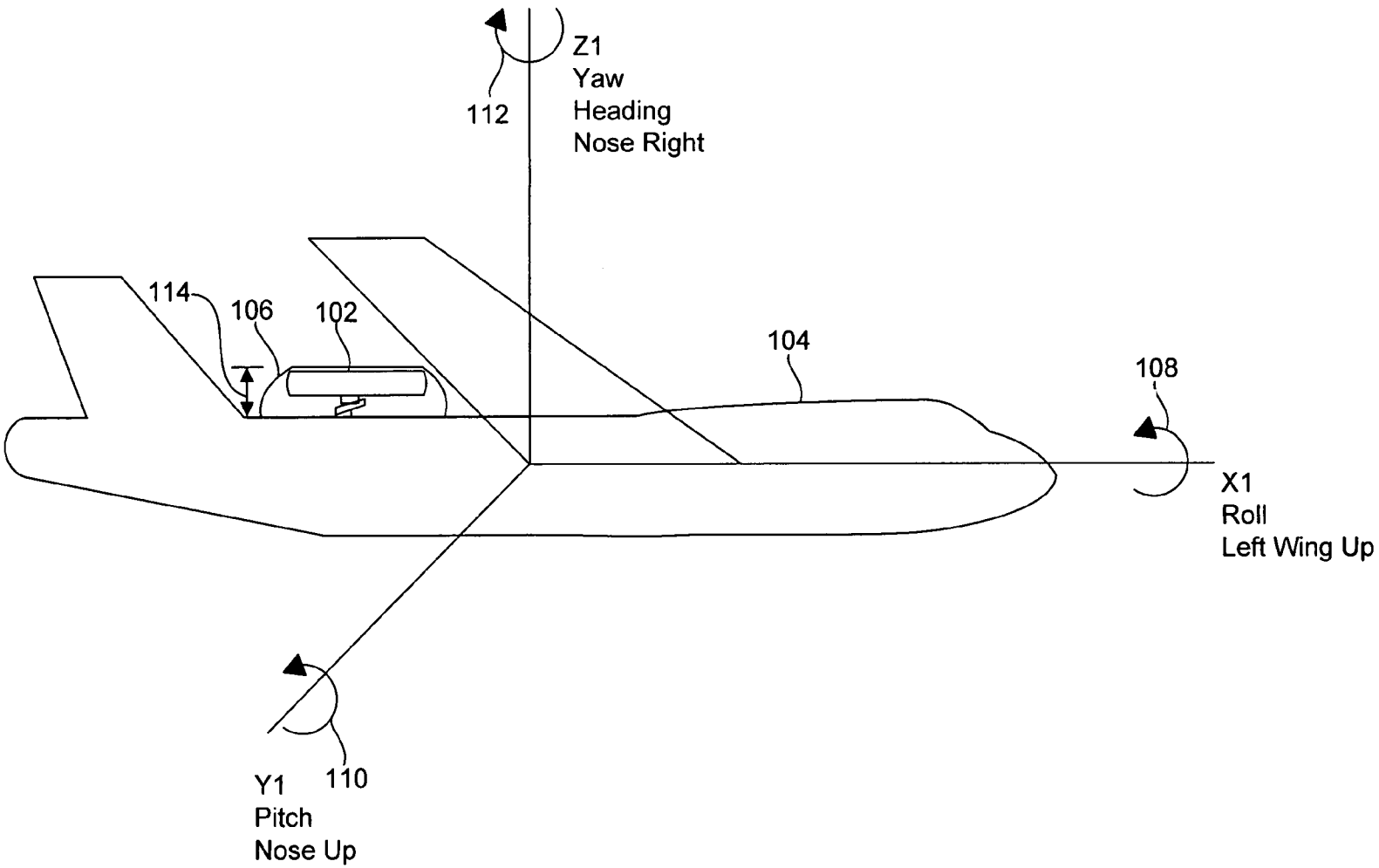
FIG. 1 is an illustration of an antenna mounted in a radome on an aircraft, in accordance with an embodiment of the present invention.

Reference will now be made to the exemplary embodiments illustrated in the drawings, and specific language will be used herein to describe the same. It will nevertheless be understood that no limitation of the scope of the invention is thereby intended. Alterations and further modifications of the inventive features illustrated herein, and additional applications of the principles of the inventions as illustrated herein, which would occur to one skilled in the relevant art and having possession of this disclosure, are to be considered within the scope of the invention.

An antenna can be placed on a pedestal which can be used to control movement of the antenna with a plurality of gimbals. One gimbal can be used for each axis or dimension of movement desired. The gimbals can be controlled using electric motors. Accurate gimbal movement can be obtained using alternating current (AC) or direct current (DC) motors which can be electrically controlled using a gimbal direction module with feedback. The gimbal direction module can comprise hardware, firmware, software, or a combination. The gimbal direction module can be located within the pedestal or it can be an external source in communication with the gimbals in the pedestal. In one embodiment, the gimbal direction module can be an external computer source. The computer source can command the gimbal motors to move with a specific torque to a predetermined velocity and position as measured by the gimbal resolvers. Position feedback from the resolvers can be used to determine motor torque. The computer source can receive navigation information from the aircraft inertial navigation system and direct the antenna toward a correct line of sight using the navigation information to control the gimbal motors and angles. This will be discussed more fully below.

The shape and area of an antenna aperture can be determined by the frequency of the electromagnetic radiation to be transmitted and/or received by the antenna, the power to be transmitted and/or received, and the desired beam pattern of the antenna. An antenna used for communication with satellites in Earth orbit are typically parabolic dish shaped, oblong-flat phased array, or oblong-flat continuous transverse stub (CTS) antennas. Although phase-array or CTS antennas can be electronically beam steered, pedestal gimbals may be required if the maximum steered angles are limited. A parabolic dish shape can be used to focus a signal having a low amount of power. The parabolic dish shape and oblong phase-array antennas can have a width greater than a height in order to operate in a radome of reduced height while still having a surface area large enough to focus a low power signal from a satellite.

Standard two-axis pedestals suffer from extremely high rates of change of the gimbal controlling the azimuth direction when the antenna is pointed near the zenith. If the gimbal is not able to keep the antenna pointed in a direct line of sight to the satellite, the link between the satellite and the aircraft may be broken. A three-axis pedestal can give relief to the high rates of change in two-axis systems. The three-axis gimbaled pedestal, however, can allow physical interference between an antenna and a flattened radome causing large mispointing errors, which may break the communications link between the antenna and a satellite.

The present invention can be used to direct an antenna mounted on an aircraft along a substantially correct line of sight toward another antenna. Although this document may refer to aircraft to satellite communications, the correct line of sight may also be toward an antenna on a satellite, another aircraft, a ship, a moving target on the ground, or a ground based antenna.

Airplane to satellite communication can require rapid, accurate movement of an antenna to maintain a focused line of sight between the antenna and the satellite. A two axis system using two gimbals can be used to direct an antenna in a restricted radome to enable simple control of the antenna while minimizing any potential contact between the restricted radome and the antenna. However, certain gimbal angles in a two-axis system can require excessive velocity of one of the gimbals, causing the antenna to enter a keyhole where the line of sight between the antenna and satellite is lost and communications can be disrupted. The keyhole is defined to be an area in which excessive gimbal rates are required to accurately point an antenna mounted on a two-gimbal pedestal.

A three-axis system can be used while the antenna is in the keyhole to compensate for the excessive velocity required of a two-axis system and allow the antenna to maintain a line of sight with the satellite. Use of the two-axis system can be returned to when the antenna has exited the keyhole. The use of a complementary two and three axis system can enable the antenna to point in substantially any hemispherical direction while the aircraft is in flight and avoid antenna-radome interference while minimizing the complexity of the overall system.

A system and method for controlling an antenna mounted on a three-axis gimbaled pedestal located in a radome having a reduced height can allow the antenna to be efficiently controlled and pointed while minimizing the risk of antenna-radome interference, while maximizing the area in which the antenna can be correctly aligned with the line of sight between the antenna and a satellite.

The present invention provides a system and method for enabling substantially continuous communication between an aircraft and a satellite over a substantially hemispherical area above the earth while the aircraft is in flight. An aircraft having an antenna is illustrated in the example embodiment of FIG. 1. The antenna 102 can be mounted on the aircraft 104 and enclosed in a radome 106. The radome can be used to protect the antenna from the harsh environments present while the aircraft is in flight. The radome can be shaped such that aerodynamic drag is substantially minimized. The antenna inside the radome can point in substantially any hemispherical direction to satellites in geosynchronous, polar, or low earth orbits.

The aircraft can change in both position and attitude while in flight. Positional changes can be measured in changes in longitude, latitude, and altitude. Attitude changes can be measured in roll 108, which can correspond with angular movement about an $X_1$ axis of the aircraft. Roll is positive when the right wing of the aircraft is moved down. A second dimension, referred to as pitch 110, can correspond with movement about a $Y_1$ axis. Pitch is positive when the nose of the aircraft is moved up. A third dimension, referred to as yaw 112, can correspond with movement about the $Z_1$ axis, in other words a change in heading of the aircraft. Yaw is positive when a pilot moves the nose of the aircraft to his or her right.

Figure 2:
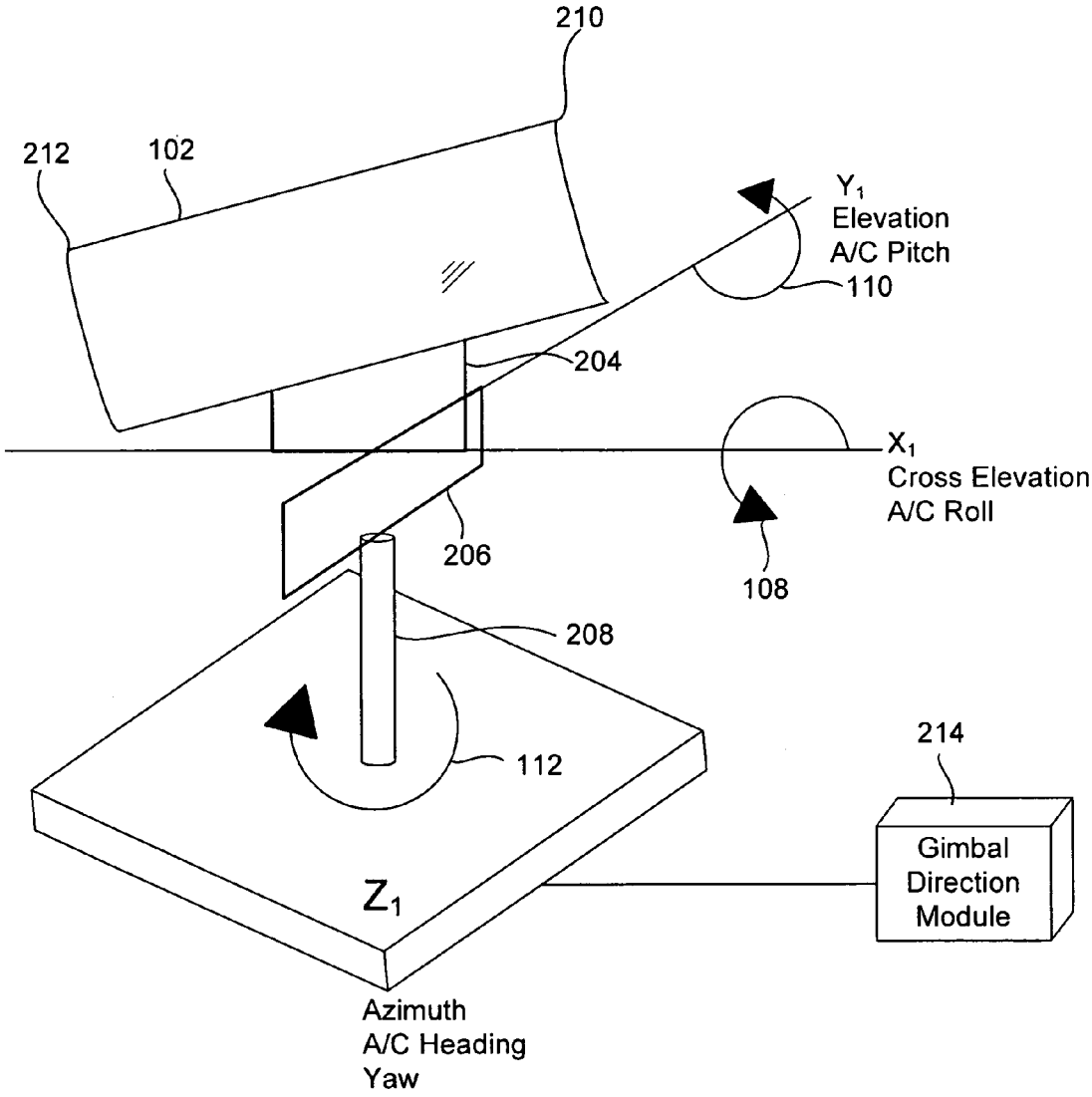
FIG. 2 is a diagram showing an embodiment of the present invention of an antenna mounted on a three-axis pedestal.

When the antenna 102 is being used to communicate with a satellite the antenna is substantially focused on a direct line of sight to the satellite in order to transmit and receive a maximum amount of energy. The antenna can be mounted on a pedestal having multiple gimbals used to control the direction of the antenna. As the aircraft moves during flight, the antenna position can be continually updated by the gimbals to maintain a substantial focus on the satellite. In particular, if the antenna axes are aligned with the aircraft axes as shown in FIG. 2, then movement of the antenna about the $X_1$ axis, corresponding to aircraft roll 108, can be compensated for with movement from a cross elevation gimbal 204, as shown in FIG. 2. Movement about the $Y_1$ axis, corresponding to a change in the pitch 110 of the aircraft, can be compensated for with movement from an elevation gimbal 206. Movement about the $Z_1$ axis, corresponding to aircraft yaw 112, can be compensated for with movement from an azimuth gimbal 208. The movement of the antenna by the gimbals can be controlled by a gimbal direction module 214, as previously discussed.

The shape of the radome 106 (FIG. 1) in which the antenna is placed on the aircraft can be a constraint on the movement of the antenna. For example, a radome mounted on an aircraft may have a flattened top to decrease wind resistance when the aircraft is in flight, as previously discussed. In one embodiment, the radome may have a height 114 as low as 10 inches. In contrast, the antenna 102 must be at least a certain size in order to transmit and receive a signal with the enough power to communicate with a satellite. As a consequence of the flattened radome and the shape of the antenna, the antenna may strike the shortened radome if it is moved in a certain direction. When two gimbals are used to move the antenna on two axes, the shape of the radome can be configured such that the antenna is physically limited from striking the radome. However, when a three axis system is used to move the antenna, the radome would need to be a sphere having a circumference greater than the maximum width of the antenna to prevent any contact with the antenna. Unfortunately, a spherical radome is not conducive to minimizing aerodynamic drag on an aircraft.

Movement of the gimbals in a three axis system can be constrained to allow the antenna to be positioned correctly with a three-axis system, using the azimuth, elevation, and cross elevation gimbals, while still placing the antenna in a shortened, essentially flattened radome. In one embodiment, shown in FIG. 2, the azimuth gimbal 208 can be allowed to move 360°, while the elevation gimbal 206 can be allowed to move between 0° and 120°, and the cross elevation gimbal 204 can be constrained to move between ±10°. Movement of the cross elevation gimbal beyond ±10° can cause contact between the sides 210 and 212 of the antenna and the radome. The cross elevation gimbal can be rotatably attached to the antenna. The long axis of the antenna can be along the axis of the elevation gimbal. Each gimbal's angle of movement can be measured with respect to the aircraft attitude on which it is mounted and the aircraft attitude angles are measured relative to the tangential plane of the aircraft by the inertial navigator. The aircraft's tangential plane is orthogonal to a gravity vector. The gravity vector points in the direction of the gravitational pull caused by the Earth. Measurement of the tangential plane with respect to the gravity vector can be accomplished using an inertial navigation system, as will be discussed more fully below.

The antenna 102 can typically be directed towards a satellite using any two of the three gimbals. In one embodiment, the antenna can be controlled with a pedestal using 2-axis controls with the azimuth gimbal 208 and the elevation gimbal 206. The required rate of change and acceleration of the gimbals in order for the antenna to maintain focus on a satellite can be given by the following equations:

$$\frac{dAz}{dt} = -\mathrm{Cos}Az\mathrm{Tan}El\frac{dR}{dt}, \tag{1}$$

$$\frac{d^2Az}{dt^2} = \mathrm{Sin}Az\mathrm{Tan}EL\left(\frac{dR}{dt}\right)\left(\frac{dAz}{dt}\right) - \mathrm{Cos}Az\mathrm{Tan}El\frac{d^2R}{dt^2}, \tag{2}$$

where AZ is the angle of the azimuth gimbal, EL is the angle of the elevation gimbal, R is the angle of the aircraft's roll 108, $$\frac{dAz}{dt}$$

is the rate of change in azimuth per the rate of change in time and $$\frac{dR}{dt}$$

is the rate of change in roll per the rate of change in time. The acceleration of the azimuth gimbal is represented by $$\frac{d^2Az}{dt^2},$$

and $$\frac{d^2R}{dt^2}$$

is the acceleration of the aircraft's roll.

As the angle of the elevation gimbal 206 approaches 90° in a two-axis system, the tangential component of the angle of the azimuth gimbal's 208 rate of change and acceleration necessary to keep the antenna pointed at a specific satellite approaches infinity. The azimuth gimbal may be unable to keep up with the required rate of change and acceleration, due to the physical limitations of its motors, as the angle of the elevation gimbal approaches 90°, causing the communication link between the antenna 102 and the satellite to be interrupted until the line of sight between the antenna and the satellite can be correctly aligned. When the antenna is pointed in a direction in which it is unable to correctly transmit or receive, it is typically referred to as being in a keyhole. A keyhole is defined as an area in which an antenna cannot communicate. In aircraft to satellite communications, this keyhole can occur as the angle of the elevation gimbal approaches 90°.

Temporary losses of a communication link may be acceptable in some circumstances, such as where the need for a low complexity system outweighs the need for a continuous communication link. In other situations, however, such as high speed military communications, the loss of the data link can be prohibitive in a complex system requiring large amounts of data to be transmitted. Similarly, communications during reconnaissance missions and at times of war can require a much greater likelihood of successful transmission. The present invention is a system and method for directing an antenna located in a restrictive radome using a pedestal having a 3-axis system. The system and method can reduce or eliminate interruptions in communication when a line of sight between the antenna and the satellite enters a keyhole.

Figure 3:
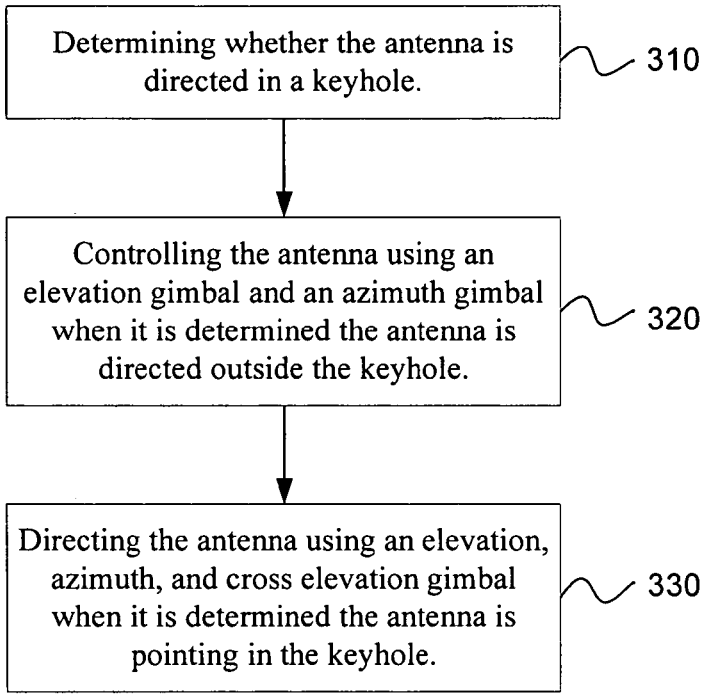
FIG. 3 is a flow chart depicting an embodiment of a method for directing an antenna mounted in a restricted radome on an aircraft.

One aspect of the present invention provides a method for directing an antenna mounted in a restrictive radome on an aircraft, as disclosed in the flow chart of FIG. 3. The method includes the operation of determining whether the antenna is directed in a keyhole, as shown in block 310. As previously discussed, a keyhole can be defined where azimuth gimbal rates are too high for a two axis gimbal pedestal system to accurately direct the antenna to the correct point. The flight conditions which can cause the azimuth rates to be too great can be determined in advance. Sensors on the aircraft can then be used to measure the roll, pitch, and yaw of the aircraft to determine whether the line of sight between the antenna and a satellite is within a keyhole. In one embodiment, the antenna's location in a keyhole can be defined as occurring when the angle of the elevation gimbal is greater than 80°.

The method includes the further operation of controlling the antenna using an elevation gimbal and an azimuth gimbal when it is determined the antenna is directed outside the keyhole, as shown in block 320. When the angle of the elevation gimbal is less than 80°, the antenna can be controlled using two gimbals to compensate for most aircraft movement, thus substantially insuring that the communication link can be maintained. Another operation involves directing the antenna using an elevation, azimuth, and cross elevation gimbal when it is determined the antenna is pointing in the keyhole, as shown in block 330. This will be more fully described below.

Figure 4A:
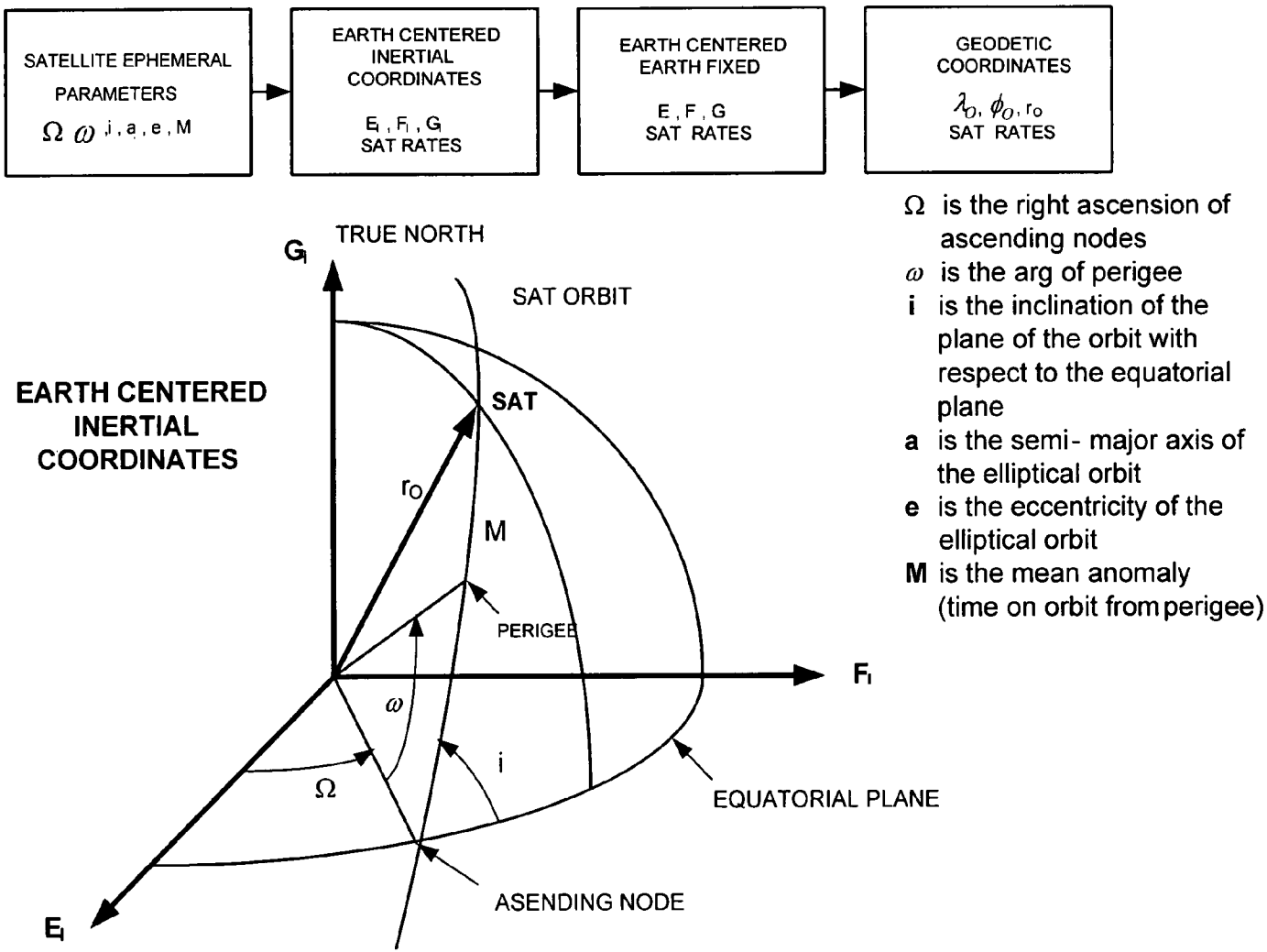
FIG. 4*a* is a diagram showing satellite orbital coordinate transforms and an illustration of an Earth centered inertial coordinate system.

The method can be further described with the illustrations in FIGS. 4*a*, 4*b*, 5, and 6. FIG. 4*a* is a block diagram which shows the sequence of calculations required to calculate latitude, longitude, and radial position of a satellite starting from its ephemeris parameters. The satellite's ephemeris parameters can be transformed into geodetic coordinates, as shown in FIG. 4*a*. Satellite orbit coordinate transformations are well known to those skilled in the art. Further details can be obtained in the White Sands Missile Range document "Global Coordinate System", Document 151-85.

Figure 4B:
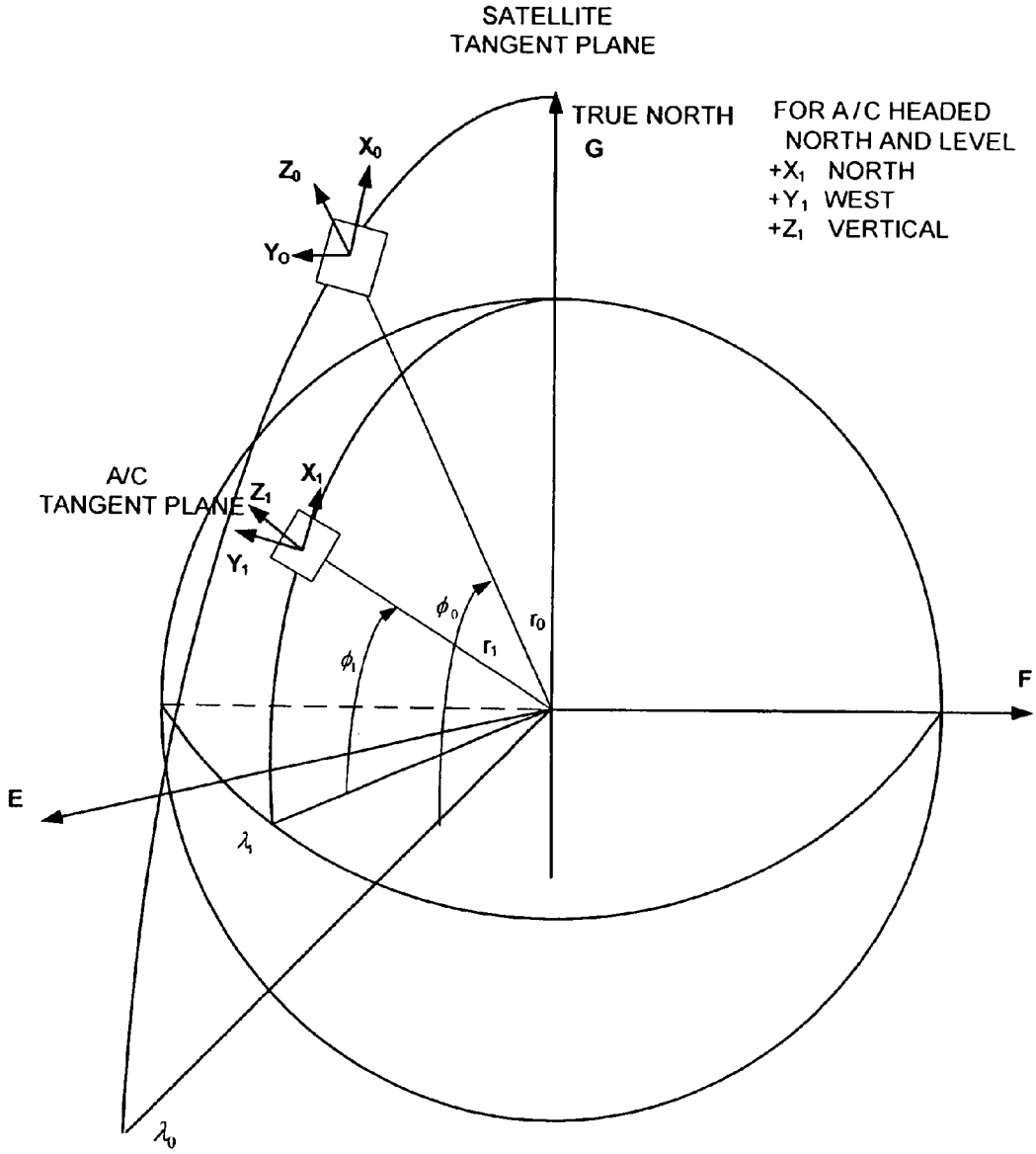
FIG. 4*b* is an illustration of an Earth centered-earth rotating coordinate system showing rotations between an aircraft and a satellite.

FIG. 4*b* shows the centered-earth rotating coordinates showing rotations between an aircraft and a satellite. When an aircraft is headed due North and in level flight then $+X_1$ is North, $+Y_1$ is West, and $+Z_1$ is vertical. As an aircraft is in flight, the actual direction of $X_1$, $Y_1$, and $Z_1$ is in constant flux. One technique for tracking the direction of $X_1$, $Y_1$, and $Z_1$ while the aircraft is in flight is to measure changes in velocity, position (longitude, latitude, and altitude), and attitude (roll R, pitch P, and heading H) of the aircraft. In one embodiment, the change in roll, pitch, and heading of an aircraft can be determined by an inertial navigation system (INS) which has the means to accurately measure such changes. Once the roll, pitch and heading are known, the actual direction of $X_1$, $Y_1$, and $Z_1$ in aircraft coordinates can be determined by the following aperture LOS pointing equation:

$$\underset{\substack{LOS\ \text{IN}\\ A/C\ COOR}}{\begin{bmatrix} X_1 \\ Y_1 \\ Z_1 \end{bmatrix}} = \underset{+X\ \text{ROTATION}}{\begin{bmatrix} 1 & 0 & 0 \\ 0 & CR & SR \\ 0 & -SR & CR \end{bmatrix}} \underset{-Y\ \text{ROTATION}}{\begin{bmatrix} CP & 0 & SP \\ 0 & 1 & 0 \\ -SP & 0 & CP \end{bmatrix}} \underset{-Z\ \text{ROTATION}}{\begin{bmatrix} CH & -SH & 0 \\ SH & CH & 0 \\ 0 & 0 & 1 \end{bmatrix}} \times \underset{+Y\ \text{Rotation}}{\begin{bmatrix} C\varphi_1 & 0 & -S\varphi_1 \\ 0 & 1 & 0 \\ S\varphi_1 & 0 & C\varphi \end{bmatrix}} \tag{3}$$

$$\underset{-X\ \text{ROTATION}}{\begin{bmatrix} 1 & 0 & 0 \\ 0 & C\Delta & -S\Delta \\ 0 & S\Delta & C\Delta \end{bmatrix}} \underset{-Y\ \text{ROTATION}}{\begin{bmatrix} C\varphi_0 & 0 & -S\varphi_0 \\ 0 & 1 & 0 \\ -S\varphi_0 & 0 & C\varphi_0 \end{bmatrix}} \times \begin{bmatrix} 0 \\ 0 \\ |r_0| \end{bmatrix} - \begin{bmatrix} 0 \\ 0 \\ |r_1| \end{bmatrix}$$

where S is sine, C is cosine, R is roll, P is pitch, and H is heading, or yaw. The aircraft latitude is represented by $\phi_1$, $\Delta$ is equal to the longitude difference of $\lambda_0-\lambda_1$, and $\phi_0$ is the satellite latitude. The vector length to the satellite is represented by $r_0$ and $r_1$ is the vector length to the aircraft in the $Z_1$ direction. The vector difference of $r_0$ and $r_1$ is the antenna line of sight. Equation 3 can be simplified to be:

$$\underset{\substack{LOS\ \text{IN}\\ A/C\ COOR}}{\begin{bmatrix} X_1 \\ Y_1 \\ Z_1 \end{bmatrix}} = \underset{\text{AIRCRAFT ROTATIONS}}{\begin{bmatrix} CP\ SH & -CP\ SH & SP \\ CR\ SH - SR\ SP\ CH & CR\ CH + SR\ SP\ SH & SR\ CP \\ -SR\ SH - CR\ SP\ CH & -SR\ CH + CR\ SP\ SH & CR\ CP \end{bmatrix}} \underset{\text{EARTH ROTATIONS}}{\begin{bmatrix} C\varphi_1 S\varphi_0 - S\varphi_1 C\varphi_0 C\Delta \\ -C\varphi_0 S\Delta \\ C\varphi_1 C\varphi_0 C\Delta + S\varphi_1 S\varphi_0 - |r_1/r_0| \end{bmatrix}} |r_0| \tag{4}$$

Figure 5:
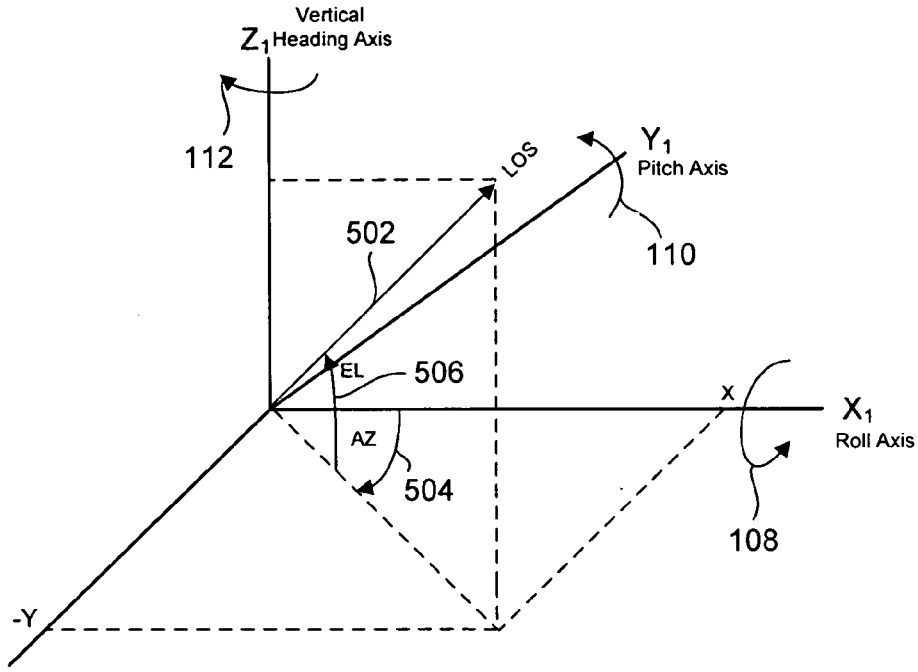
FIG. 5 is a diagram depicting a graph showing axis antenna coordinates relative to the aircraft on which the antenna is mounted for an antenna directed with two gimbals.

FIG. 5 depicts a graph showing the axis antenna coordinates relative to the aircraft on which the antenna is mounted for an antenna directed with two gimbals. The antenna can be directed to the line of sight between the aircraft and a satellite by adjusting the angles of an azimuth gimbal 504 and an elevation gimbal 506. The elevation and azimuth gimbals can be used to counter the aircrafts roll 108 ($X_1$), pitch 110 ($Y_1$), and heading 112 ($Z_1$), or yaw. The values of $X_1$, $Y_1$, and $Z_1$ can be determined using equation 4 and the values of the roll, pitch, and heading of the aircraft from the inertial navigation system.

When the angle of the azimuth gimbal is such that the antenna is not directed toward the keyhole, the azimuth and elevation angles can be computed using the following equations:

$$\text{Tan}Az = \frac{-Y_1}{X_1}, \tag{5}$$

$$\text{Tan}El = \frac{Z_1}{\sqrt{X_1^2 + Y_1^2}}. \tag{6}$$

When the aircraft's angle of elevation approaches 90°, the values of $X_1$ and $Y_1$ become small, which can make the tangential azimuth rate component large, as in Equation 1. The large tangential azimuth rate can cause the velocity of the azimuth gimbal to become excessive, as previously discussed. A third gimbal, a cross-elevation gimbal, can be used to reduce the velocity at which the azimuth gimbal must move.

Figure 6:
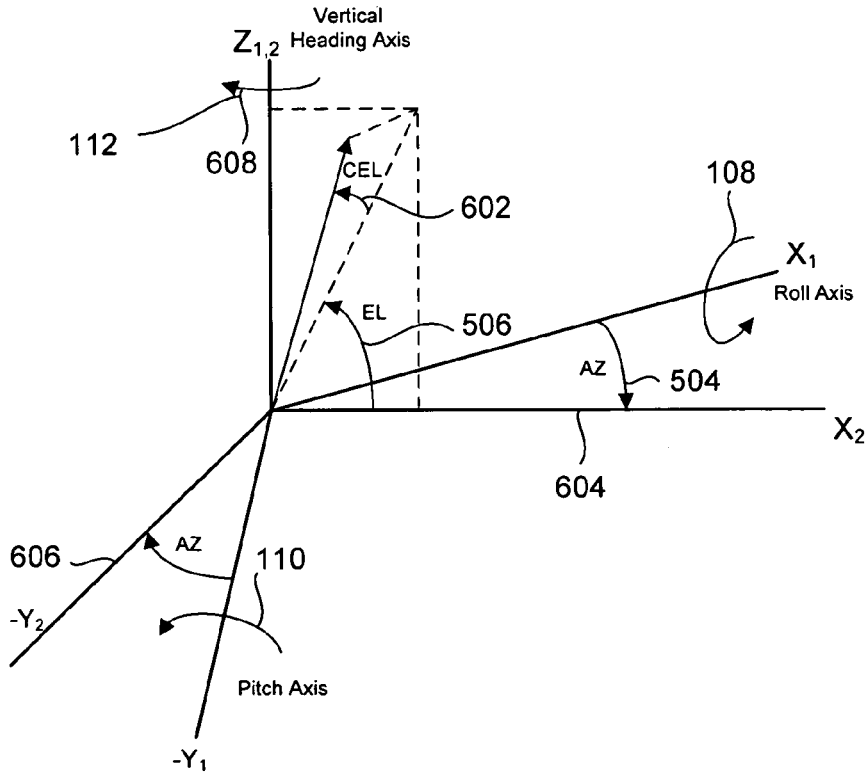
FIG. 6 is a diagram depicting a graph showing axis antenna coordinates relative to the aircraft on which the antenna is mounted for an antenna directed using three gimbals.

FIG. 6 illustrates a graph showing the axis antenna coordinates relative to the aircraft on which the antenna is mounted for an antenna directed using three gimbals. In this instance, the antenna can be directed to the line of sight between the aircraft and a satellite by adjusting the azimuth gimbal 504, the elevation gimbal 506, and a cross elevation gimbal 602. The addition of the third gimbal can increase the complexity of the antenna positioning system.

When two gimbals are used to position the antenna, a definite angle for each of the two gimbals can be determined for each position of the antenna. When a third gimbal is added, there can be multiple solutions for each position of the antenna. Besides the original axes of the aircraft's roll 108 ($X_1$), pitch 110 ($Y_1$), and vertical heading 112 ($Z_1$), or yaw, additional axes $X_2$ 604, $Y_2$ 606, and $Z_2$ 608 ($Z_2$=$Z_1$) can be used to find a solution for each positioning of the antenna. The values for $X_2$, $Y_2$, and $Z_2$ can be found using the following equation:

$$\begin{bmatrix} X_2 \\ Y_2 \\ Z_2 \end{bmatrix} = \begin{bmatrix} CAz & -SAz & 0 \\ SAz & CAz & 1 \\ 0 & 0 & 1 \end{bmatrix} \begin{bmatrix} X_1 \\ Y_1 \\ Z_1 \end{bmatrix}, \tag{7}$$

where CAz is the cosine of the azimuth angle and SAz is the sine of the azimuth angle. The azimuth gimbal angle Az can be arbitrary but must be measured by the corresponding resolver for calculations in Equation 7. The elevation, and cross elevation angles can be found from the equations:

$$\mathrm{Tan}El = \frac{Z_2}{X_2} = \frac{Z_1}{\sqrt{X_1^2 + Y_1^2}}, \tag{8}$$

$$\mathrm{Tan}CEl = \frac{-Y_2}{\sqrt{X_2^2 + Z_2^2}}. \tag{9}$$

Because more than one solution is possible for each position at which the antenna is pointed, a solution can be selected which can enable the azimuth gimbal 504 to have a limited velocity. In one embodiment, a solution can be found which allows the azimuth gimbal to maintain a velocity below ±60° per second.

In the keyhole under 3-axis control, the azimuth angle can be any angle limited by a maximum rate and the remaining elevation and cross-elevation gimbals can be set so that the antenna is substantially always pointed down the line of sight to the satellite correctly. The azimuth gimbal angle can be chosen to minimize the azimuth gimbal velocity, particularly during exit from and in the keyhole.

When the 3-axis azimuth gimbal is required to move at a high rate of speed the actual gimbal resolver measurement $Az_R$ may lag behind the azimuth gimbal command $Az_C$ sent to the gimbal. This will result in an error in the positioning of the azimuth gimbal. The error term can be described by the equation:

$$Az_E = Az_C - Az_R \tag{10},$$

where $Az_E$ is the azimuth gimbal position error. The azimuth gimbal position error is acceptable within the keyhole because the azimuth gimbal can be set at any angle. Consequently, the value of $Az_R$ can be used rather than $Az_C$ for determining the location of the cross elevation gimbal while the antenna is in the keyhole and the azimuth error $Az_E$ is greater than a predetermined number. In one embodiment, the value of $Az_R$ can be used rather than $Az_C$ when $Az_E$ is greater than +0.1 degrees. In that case, equation 7 becomes:

$$\begin{bmatrix} X_2 \\ Y_2 \\ Z_2 \end{bmatrix} = \begin{bmatrix} CAz_R & -SAz_R & 0 \\ SAz_R & CAz_R & 1 \\ 0 & 0 & 1 \end{bmatrix} \begin{bmatrix} X_1 \\ Y_1 \\ Z_1 \end{bmatrix}, \tag{11}$$

with the values of $X_2$, $Y_2$, and $Z_2$ used to determine the cross elevation calculation in equation 9.

When the antenna exits the keyhole then the cross elevation gimbal can be set to 0° and the antenna can be pointed using only the azimuth and elevation gimbals. Consequently, it is important for the azimuth error to be small. Otherwise, the antenna may not be able to be properly pointed using only two of the gimbals. Therefore, exit from the keyhole may occur when the $Az_E$ is less than a predetermined amount and when the elevation gimbal is less than 90°. In one embodiment, the antenna can be allowed to exit the keyhole, placing the cross elevation gimbal at 0° and using the azimuth and elevation gimbals to point the antenna when the azimuth gimbal pointing error, $Az_E$, is less than ±0.1° and the elevation gimbal is at an angle of less than 80°. The azimuth and elevation gimbals can then be directed using equations 5 and 6 respectively and setting the cross elevation gimbal to 0°.

In bank turns, the line of sight between the antenna mounted on the aircraft and the satellite can enter and exit the keyhole relatively quickly. For example, an aircraft may make a bank turn of 30°. The keyhole may typically be 20° wide. Thus, the line of sight may quickly enter the keyhole area, where the elevation gimbal has an angle greater than a predetermined number, such as 80°. The pedestal can then use a 3-axis system comprising three orthogonal gimbals to maintain the line of sight. As the airplane continues its bank turn, the elevation gimbal may again return to an angle of less than 80°. However, the azimuth gimbal may not be able to keep up with a rapid bank turn, causing a large azimuth error to occur. Thus, even though the angle of the elevation gimbal may return below 80°, the pedestal will continue using a three-axis system until the azimuth error, $Az_E$ is less than a predetermined number, as previously discussed. Once the azimuth error is less than the predetermined number, the pedestal can revert to using a simpler 2-axis system comprising two orthogonal gimbals to direct the antenna mounted on the aircraft.

It is to be understood that the above-referenced arrangements are illustrative of the application for the principles of the present invention. It will be apparent to those of ordinary skill in the art that numerous modifications can be made without departing from the principles and concepts of the invention as set forth in the claims.

What is claimed is:

1. A method for directing an antenna mounted in a radome on an aircraft, comprising the steps of:

providing a flattened radome configured to substantially minimize aerodynamic drag caused by wind flow past the flattened radome and to cover the antenna, wherein the antenna has a width dimension which is at least three times larger than a height dimension;

determining whether the antenna is directed in a keyhole;

controlling the antenna using an elevation gimbal and an azimuth gimbal when it is determined that the antenna is pointing outside the keyhole, wherein the antenna is pointing outside the keyhole when the elevation gimbal is directed at an angle of less than 80 degrees with respect to a tangential plane of the aircraft and an azimuth error value of the azimuth gimbal is less than ±0.1 degrees with respect to the tangential plane of the aircraft; and directing the antenna using an elevation, azimuth, and cross elevation gimbal when it is determined the antenna is pointing in the keyhole.

2. A system for enabling substantially continuous communication between an aircraft and a receiver over a substantially hemispherical area above the earth while the aircraft is in flight, comprising:

an antenna configured to communicate with a receiver, wherein the antenna has a width dimension that is greater than a height dimension;

a flattened radome configured to house the antenna outside the aircraft while minimizing resistance to airflow past the aircraft;

an antenna pedestal configured to support and direct the antenna, the antenna pedestal having an elevation gimbal, a cross elevation gimbal, and an azimuth gimbal, the gimbals configured to move the antenna; and a gimbal direction module configured to direct the antenna using two gimbals when the antenna is directed to point outside a keyhole and three gimbals when the antenna is directed to point inside the keyhole.

3. A system as in claim 2, wherein the receiver is located on an Earth orbiting satellite.

4. A system as in claim 2, wherein electric motors are used to move the gimbals.

5. A system as in claim 2, wherein the gimbal direction module is hardware located external to the pedestal.

6. A system as in claim 5, wherein the hardware is a computer configured to receive roll, pitch, and yaw headings of the aircraft from an inertial navigation system and translate the headings to correctly point the antenna to the receiver.

7. A system as in claim 2, wherein the antenna is directed toward the keyhole when one or more of the elevation gimbal, cross elevation gimbal, or azimuth gimbal is directed at an angle which is greater than a predetermined amount.

8. A system as in claim 7, wherein the antenna is directed toward the keyhole when the azimuth gimbal is directed at an azimuth angle of greater than 80 degrees.

9. A system as in claim 7, wherein the antenna is directed with the antenna pedestal using a two-axis system comprising two orthogonal gimbals when the antenna is directed away from the keyhole.

10. A system as in claim 7, wherein the antenna is directed with the antenna pedestal using a two-axis system comprising the elevation gimbal and the azimuth gimbal when the antenna is directed away from the keyhole.

11. A system as in claim 2, wherein the antenna is directed with the antenna pedestal using a three-axis system comprising the elevation gimbal, the cross elevation gimbal, and the azimuth gimbal when the antenna is directed toward the keyhole.

12. A system as in claim 2, wherein the azimuth gimbal can rotate at a velocity of up to ±60 degrees per second.

13. A system as in claim 2, wherein the cross elevation gimbal can be set at a cross elevation angle that will enable the azimuth gimbal to rotate at a velocity of less than ±60 degrees per second when a line of site between the antenna and the receiver is within the keyhole.

14. A system as in claim 2, wherein the gimbals are located within the pedestal.

15. A system as in claim 2, wherein the antenna is selected from the group consisting of an elongated dish, an elongated parabolic dish, a rectangular phased array, a flat phased array, and a continuous transverse stub antenna.

16. A system as in claim 15, wherein the width dimension of the antenna is at least 2.5 times greater than the height dimension.

17. A system as in claim 16, wherein the width dimension of the antenna is directed along an axis of the elevation gimbal.

18. A system as in claim 2, wherein the cross elevation gimbal is rotatably attached to the antenna.

19. A system as in claim 2, wherein the azimuth gimbal is attached to the aircraft.

20. A system as in claim 2, wherein the azimuth, elevation, and cross elevation gimbals rotate in directions substantially orthogonal to one another.

21. A system as in claim 2, wherein the flattened radome has a height dimension which is less than the width dimension of the antenna.

22. A system as in claim 21, wherein the flattened radome has a height dimension which is less than 12 inches.

23. A system for enabling substantially continuous communication between an aircraft and a receiver over a substantially hemispherical area above the earth while the aircraft is in flight, comprising:

an antenna configured to communicate with a receiver, wherein the antenna has a width dimension that is at least three times greater than a height dimension;

a flattened radome configured to house the antenna outside the aircraft while minimizing resistance to airflow past the aircraft;

an antenna pedestal configured to support and direct the antenna, the antenna pedestal having an elevation gimbal, a cross elevation gimbal, and an azimuth gimbal, the gimbals each configured to move the antenna in an orthogonal direction;

a gimbal direction module configured to direct the antenna using two gimbals when the antenna is directed to point outside a keyhole wherein the antenna is pointing outside the keyhole when the elevation gimbal is directed at an angle of less than 80 degrees with respect to a tangential plane of the aircraft and an azimuth error value of the azimuth gimbal is less than ±0.1 degrees with respect to the tangential plane of the aircraft; and the gimbal direction module further configured to direct the antenna using three gimbals when the antenna is directed to point inside the keyhole.

* * * * *